215-12.1 SR
07766 XR 4,546,529

United States Patent [19]

Martin Saint Leon

[11] Patent Number: 4,546,529

[45] Date of Patent: Oct. 15, 1985

[54] METHOD OF FABRICATING CONTAINER WITH METAL SKIN

[75] Inventor: Daniel Martin Saint Leon, L'Hay les Roses, France

[73] Assignee: Estee Lauder Inc., New York, N.Y.

[21] Appl. No.: 597,873

[22] Filed: Apr. 9, 1984

Related U.S. Application Data

[62] Division of Ser. No. 459,736, Jan. 20, 1983, abandoned.

[51] Int. Cl.[4] ..... B21D 39/00; B23P 11/00

[52] U.S. Cl. ..... 29/455 R; 29/511; 29/243.52; 215/12 R; 220/67; 413/4

[58] Field of Search ..... 29/455 R, 511, 243.52; 413/4, 5; 215/112 R, 112 A, 113 R; 220/67, 68, 410, 420, 468, 470

[56] References Cited

U.S. PATENT DOCUMENTS

| | | | |
|---|---|---|---|
| 207,007 | 8/1878 | Brooks | 220/67 |
| 208,628 | 10/1878 | Norris | 215/12 R |
| 242,471 | 6/1881 | Newton | 215/12 R |
| 1,814,080 | 7/1931 | Danco | 215/12 R |
| 2,264,524 | 12/1941 | Hale | 29/455 R UX |
| 2,316,437 | 4/1943 | Kercher | 220/468 X |
| 2,331,449 | 10/1943 | Wittenberg | 29/511 X |
| 2,649,999 | 8/1953 | Burch | 29/511 UX |
| 3,241,209 | 3/1966 | Taylor | 215/12 R |
| 3,415,413 | 12/1968 | Morley | 220/67 |

FOREIGN PATENT DOCUMENTS

| | | | |
|---|---|---|---|
| 851309 | 1/1940 | France | 29/511 |
| 914915 | 1/1963 | United Kingdom | 29/511 |

*Primary Examiner*—Charlie T. Moon
*Attorney, Agent, or Firm*—Blum Kaplan Friedman Silberman & Beran

[57] ABSTRACT

A vessel with a metal skin particularly well suited for cosmetic use is provided. The metal skin covers the shoulder region from the base of the neck over the side wall and extends inwardly over a substantially planar metal plate adhered to the bottom of the container. The metal skin is formed into a cup shape and the jar is dropped in up-side down and crimped over the metal plate on the bottom. Pre-forming the shoulder region of the metal skin avoids unsightly stress marks in the upper exposed portion of the container.

5 Claims, 5 Drawing Figures

METHOD OF FABRICATING CONTAINER WITH METAL SKIN

This is a division of application Ser. No. 459,736 drawings filed Jan. 20, 1983, now abandoned.

BACKGROUND OF THE INVENTION

Containers or vessels for storing various types of materials are available in a wide variety of sizes and shapes. Generally, the size, shape and color or label of the container varies with the particular material therein. It is often desirable to place various types of cosmetic materials, such as make-up creams or lotions in more elegant containers than generally available by merely applying a label or other typical indicia to the container. Accordingly, there are available various types of cosmetic materials in containers having metal coverings on the container and closure. While the metal covering may be of any desired color, a gold coloring obtained by anodizing a punched aluminum skin is particularly elegant. However, in the constructions available in the prior art, that portion of the metal skin covering the top curved or shoulder region of the container tends to exhibit stress lines or wrinkles caused by the crimping to follow the container shape.

In some constructions using a plastic insert the skin is left abutting a lip in order to avoid the wrinkling effect. This is not desirable as it leaves exposed a portion of the inner plastic surface of the container exposed. The plastic inner containers are force-fit into the metal skin which has been pressed into a cup shape dimensioned to receive the inner container. This procedure of force-fitting a metal skin onto a container cannot be utilized with a glass jar as the dimensions of the jar cannot be controlled sufficiently. For this reason the available glass jars with metal coverings must be crimped about the shoulder region of the jar to hold the metal skin in place.

In these conventional metal covered glass jars or bottles, the metal covering is a cylindrical capsule or cup havng a bottom and a vertically extending side wall dimensioned to receive the jar. While such metal covered containers, including the glass jars provide an elegant appearance, the stress marks in the metal in the shoulder region tend to distract from an otherwise elegant appearance. Accordingly, it would be desirable to provide a container with a metal skin or covering which avoids the stress marks in the region of the shoulder found in conventional constructions. It would be further desirable to provide a method of fabricating such a container particularly well suited for use with a glass jar having a metal skin which does not form stress marks and does not add significantly to production costs.

SUMMARY OF THE INVENTION

A container having a metal skin, wherein the metal skin extends over the side walls and top of the container so that no portion of the container is exposed when a closure is secured, is provided. The container is a vessel having a bottom, a substantially vertical side wall and an inwardly extending top section or shoulder. A neck portion may extend from the shoulder of the container for receiving a closure for closing the container. The metal skin covers the exposed surface area of the container for providing a particularly elegant container paticularly well suited for cosmetic formulations.

The metal skin on the container is a two piece construction. A first substantially planar metal plate is secured to the bottom of the container and extends to the bottom of the side wall. The second piece is a shell portion formed with a curved inwardly facing flange and opening to conform to the opening in the container. The bottom of the shell portion is crimped to overlap the edge of the metal plate. By forming the shoulder portion of the metal shell with the curved flange, crimping in an exposed region can be avoided. During assembly the container is inserted into the previously curved metal shell in an up-side down manner and the bottom open edge of the metal shell is crimped over the metal plate on the bottom of the container. Thus, stress marks, if any, occur at the base of the container and not at the more visible shoulder region.

Accordingly, it is an object of the invention to provide an improved container having a metal skin.

It is another object of the invention to provide an improved process for fabricating a container having a metal skin.

It is a further object of the invention to provide an improved cylindrical container having an inwardly extending shoulder region and threaded neck portion without stress marks in the metal skin in the shoulder region.

Still another object of the invention is to provide a cosmetic container having a metal skin wherein no portion of the surface of the container is exposed when a closure is secured onto the container.

Still a further object of the invention is to provide an apparatus for assembling the container having a metal skin in accordance with the invention.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
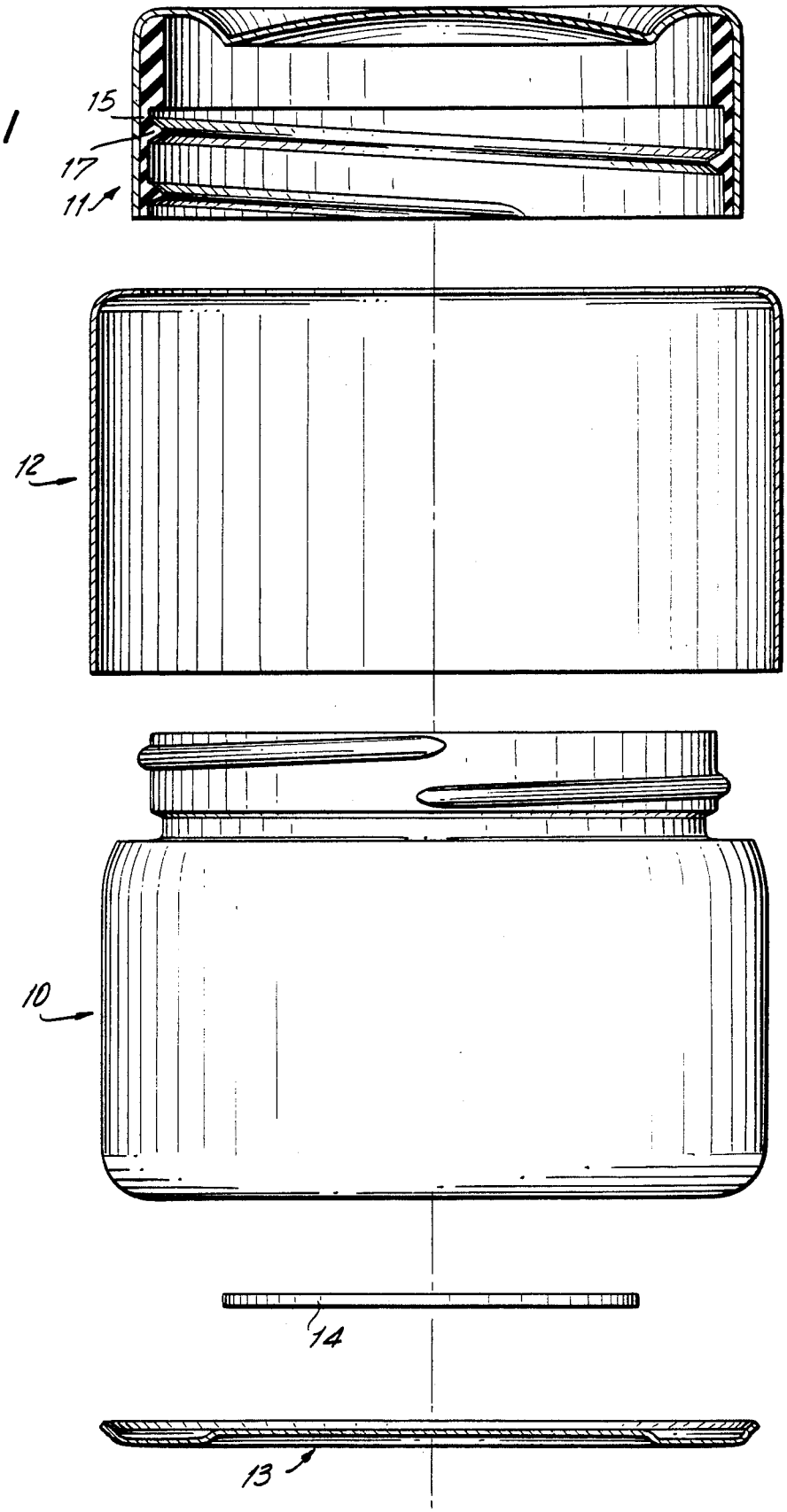
FIG. 1 is an exploded view of the elements of a container having a metal skin constructed and arranged in accordance with the invention.
Figure 2:
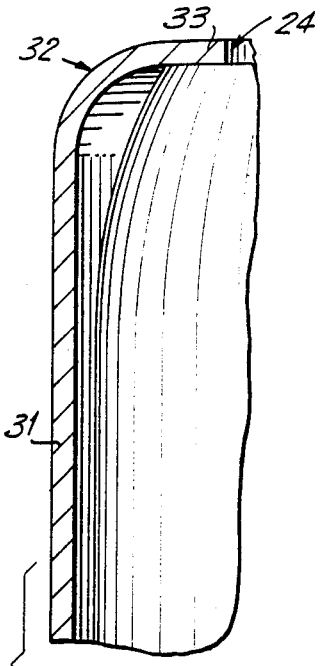
FIG. 2 is a perspective view of a container and cap having a metal skin constructed and arranged in accordance with the invention.

FIG. 1 illustrates the embodiment of a container having a metal skin constructed and arranged in accordance with the invention. The metal covered container, shown in perspective in FIG. 2 includes a substantially cylindrical jar 10, a closure cap 11, a metal shell section 12, a metal bottom plate 13 and an adhesive pad 14. Pad 14 is utilized to mount bottom plate 13 onto jar 10, absorbs shock and takes up any space between jar 10 and metal shell 12 due to the tolerance of molding glass jar 10. As shown in FIG. 2, when a jar having a metal skin is assembled in accordance with the invention, the metal skin covers the full height of jar 10 and extends under cap 11 when the container is closed.

Jar 10 in this illustrated embodiment is a cylindrical glass jar having a base 21, a substantially vertical side wall 22 extending from base 21 to form a substantially cylidrical cavity for holding a cosmetic material 23. Side wall 22 extends to a shoulder portion 24 which includes a flange 26 which extends inwardly to a vertically extending neck 27 having a thread 28 thereon. Cap 11 also has a metal skin 15 and is formed with an internal thread 17 for cooperating with thread 28 for coupling cap 11 to jar 10.

The metal skin covering jar 10 is in two sections. The first section is cylindrical shell section 12 which has a substantially cylindrical side wall 31 terminating at one end with a curved shoulder region 32 having an internally extending flange 33 and a central opening 34. The opposite end of side wall 32 of shell section 31 terminates in an open edge 36. Cylindrical metal shell section 12 is dimensioned to fit snuggly over jar 10 with opening 34 dimensioned to allow neck portion 27 to pass therethrough. The interior surface of inwardly extending flange 33 of metal shell section 12 abuts neck 27 of jar 10 as shown in the upper segment of FIG. 3. By extending flange 33 to neck 27, no surface of jar 10 will be exposed when cap 11 is secured to jar 10.

Metal bottom plate 13 is secured to bottom wall 21 of jar 10 by adhesive pad 14 which has adhesive on both sides. In the embodiment illustrated in FIG. 1, plate 13 includes a circular downwardly extending trough 41 which extends away from the bottom of jar 10 and provides a convenient base for supporting jar 10. Trough 41 includes an outer wall 42 which extends above the surface of plate 13 and includes an outermost lip 43 which is overlapped by shell section 31 as will be described in more detail below.

The metal skin may be of any material which can be formed into the desired shapes. The metal may be aluminum, brass, copper, silver, gold and the like. Preferably, the metal is aluminum or brass which are generally used in the cosmetics industry.

Metal plate 13 and shell section 12 are formed by conventional cold forming metal-working procedures. A circular piece of metal is cut from a sheet and impacted to form plate 13. Shell section 12 is formed by using a series of dies of varying shapes until the desired cup shape with curved shoulder region 32 is formed. When shell section 12 is formed opening 34 is cut out. The edges are finished and the outer surfaces of plate 13 and shell section 12 are anodized to provide the desired finish. At this time a label may be formed on the surface by use of a mask, if desired.

When assembling a jar covered with a metal skin in accordance with the invention, metal shell section 12 is supported in an inverted position in a holding fixture 51 having an internal cavity 52 and a neck opening 53 with a resilent protective collar 54 to avoid damage to thread 28. Jar 10 is turned up-side down and neck portion 27 is inserted into holding fixture 51 and through opening 34 in metal shell section 12. Shoulder region 24 of jar 10 abuts the inner surface of shoulder region 32 of metal shell 12. The diameter of metal shell section 12 is dimensioned to receive jar 10 snuggly, but due to glass tolerances an adhesive 59 may be disposed between side wall 22 of jar 10 and side wall 31 of shell section 12. Jar 10 is centered in holding fixture 51 by a centering piece 56 which a projection 57 which is displaced towards jar 10 and engages the interior of neck 27 to center jar 10. Bottom plate 13 may be mounted to the bottom of jar 10 by adhesive pad 14 before or after jar 10 is inserted in shell section 12.

Figure 3:
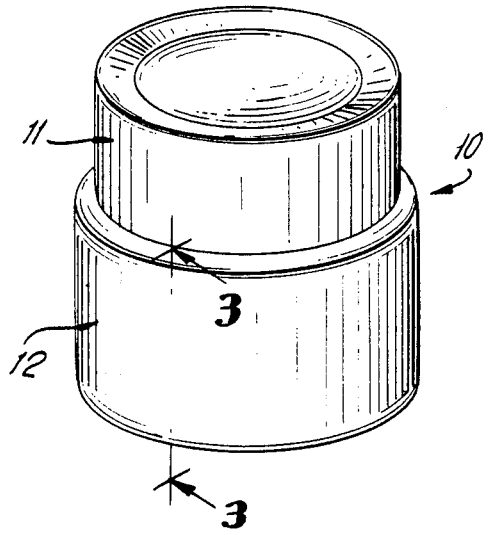
FIG. 3 is a partial cross-sectional view of a jar having a metal skin constructed and arranged in accordance with a first embodiment of the invention.
Figure 3:
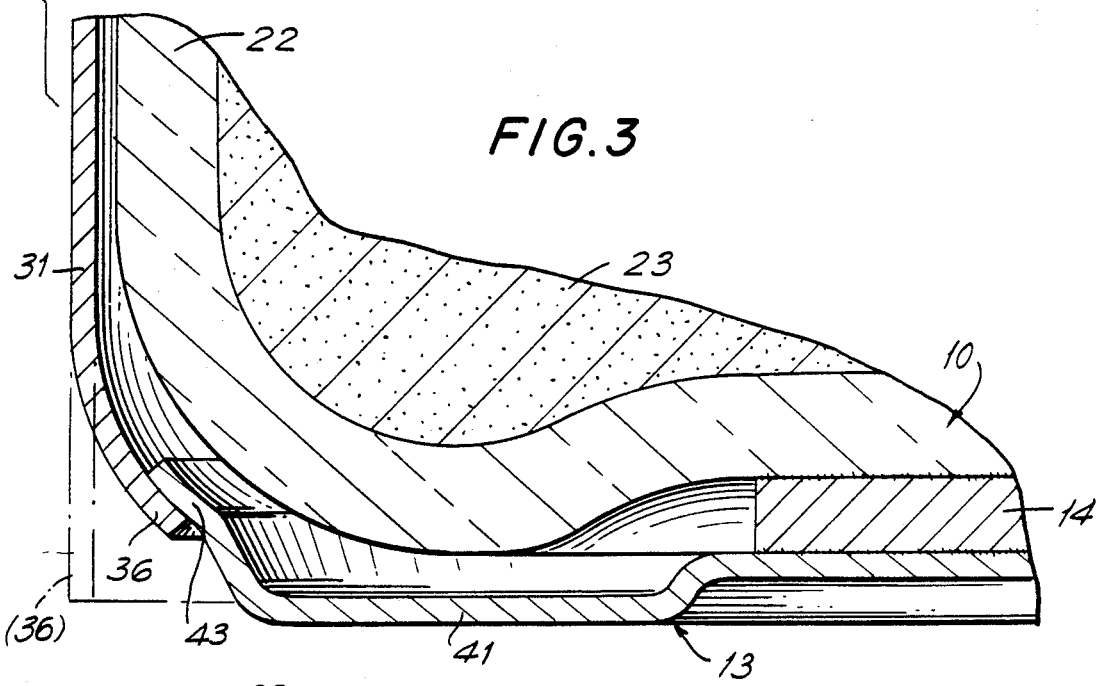
Figure 4:
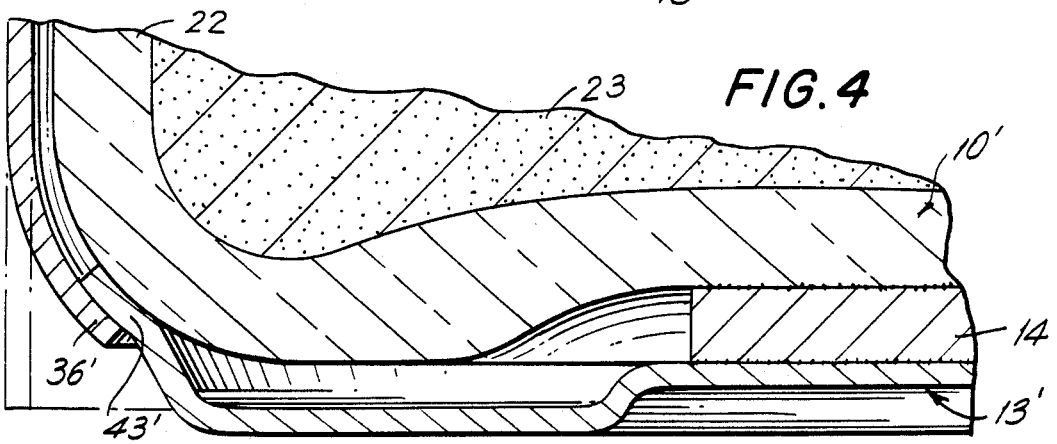
FIG. 4 is a partical cross-sectional view of a jar having a metal skin constructed and arranged in accordance with a further embodiment of the invention.
Figure 5:
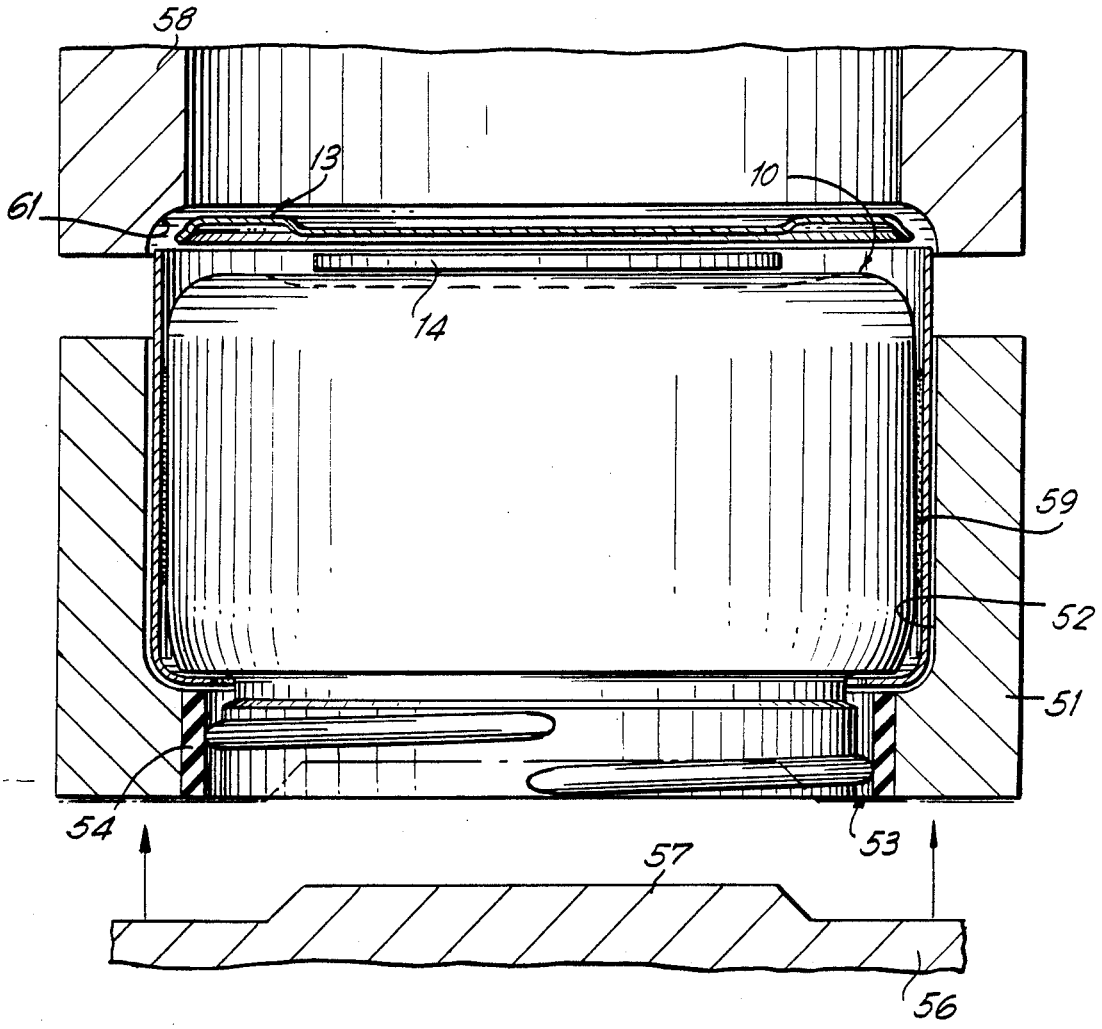
FIG. 5 is a cross-sectional view of an apparatus utilized to apply the metal skin to a jar in accordance with the invention.

At this time, open edge 34 of shell 12 is then crimped to overlap and engage lip 43 of plate 13 by a crimping tool 58 having a preselected crimping surface 61 which is displaced towards the bottom of jar 10 as shown in FIG. 3. In the alternative embodiment illustrated in FIG. 4, a lip 43' of a bottom plate 13' is positioned abuting the edge of a jar 10' at the junction between a side wall 22' and a bottom wall 21'. This apparatus provides a convenient means to crimp side wall 31 the desired degree to cover bottom plate 13 and avoid forming any significant stress marks.

By providing the metal skin for jar 10 in two sections, namely bottom plate 13 and shell section 31 having curved shoulder region 32, unsightly stress marks or wrinkles in shoulder region 32 are avoided. Prior constructions utilizing a metal capsule or cup which is turned inwardly at the shoulder of the vessel tend to form extensive stress marks. Such constructions are usually done by hand to avoid working with a die in the region of the neck to avoid damage thereto.

Open edge 36 of shell section 12 is crimped towards side wall 22 of jar 10 an angle which is substantially less than the 90° curve formed at shoulder region 32. In the embodiments illustrated open edge 36 is curved between about 20 and 60 degrees and avoids formation of any significant stress marks. A sharp right angle curve is provided in metal shell 12 at shoulder region 32 but this is formed by impact forming prior to anodizing the metal and avoids formation of the stress marks.

The container has been shown as a cylindrical jar 10. However, it is contemplated that a vessel having a square, oval or irregular section may also be covered by a metal skin in accordance with the invention.

It will thus be seen that the objects set forth above, among those made apparent from the preceding description are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method for forming a container having a metal skin on a vessel having a bottom, a side wall extending vertically from the bottom and an inwardly extending shoulder region at the top of the side wall extending inwardly to an opening for providing the access to the vessl, comprising:

placing a metal shell having an elongated side wall and curved shoulder region and central opening in a holding member;

inserting a vessel into the metal shell to abut said inwardly extending shoulder region against the curved shoulder region of the metal shell;

placing a substantially planar metal plate on the bottom of the vessel;

crimping the bottom edge of the metal shell about the metal plate to overlap said plate and clamp said plate against the bottom of the vessel therein by a crimping tool displaced towards the metal shell and bottom plate.

2. A method of forming a container having a metal skin including a vessel having a bottom, a side wall extending vertically from the bottom, and an inwardly extending shoulder region at the top of the side wall extending inwardly to an opening for providing access to the vessel, comprising:

forming a metal shell having an elongated side wall and an inwardly curved shoulder region for covering the shoulder region and side wall of the vessel, the metal shell having an opening dimensioned to cooperate with the opening in the vessel;

adhering a substantially planar bottom plate to the bottom of the vessel;

placing the shoulder region of the vessel into the metal shell with the shoulder of the vessel abutting the inwardly curved region of the metal shell; and crimping the bottom edge of the side wall of the metal skin to overlap and clamp the substantially planar bottom plate on the bottom of the vessel.

3. The method of claim 2, wherein the bottom plate is metal.

4. A method for forming a container having a metal skin on a vessel having a bottom, a side wall extending vertically from the bottom and an inwardly extending shoulder region at the top of the side wall extending inwardly to an opening for providing access to the vessel, comprising:

placing a metal shell having an elongated side wall and curved shoulder region and central opening in a holding member;

inserting a vessel into the metal shell to abut the curved shoulder region of the metal shell;

placing a substantially planar bottom plate on the bottom of the vessel;

crimping the bottom edge of the metal shell about the bottom plate to overlap said plate and clamp said plate against the bottom of the vessel therein by a crimping tool displaced towards the metal shell and bottom plate.

5. The method of claim 4, wherein the bottom plate is metal.

* * * * *